US005875668A

United States Patent [19]

Kobayashi et al.

[11] Patent Number: 5,875,668

[45] Date of Patent: Mar. 2, 1999

[54] ROLL FORMING METHOD FOR FORMING FLAT TUBE AND ROLL FORMING APPARATUS USING THE SAME

[75] Inventors: Hisashi Kobayashi, Kariya; Yuji Ogawa, Handa; Yosimitu Yamaguchi, Chita-gun; Yasuo Abe, Kariya, all of Japan

[73] Assignee: Denso Corporation, Kariya, Japan

[21] Appl. No.: 929,646

[22] Filed: Sep. 15, 1997

[30] Foreign Application Priority Data

Sep. 16, 1996 [JP] Japan ..... 8-265303

[51] Int. Cl.[6] ..... B21D 5/12

[52] U.S. Cl. ..... 72/181; 72/52; 29/890.053; 138/115

[58] Field of Search ..... 72/181, 179, 182, 72/52; 138/115; 165/172; 29/890.053

[56] References Cited

U.S. PATENT DOCUMENTS

| | | | |
|---|---|---|---|
| 455,621 | 7/1891 | Hicks | 72/181 |
| 2,655,181 | 10/1953 | Cooper | 138/115 |
| 3,707,088 | 12/1972 | King | 72/181 |
| 4,085,490 | 4/1978 | McCormick | 72/181 |
| 5,386,629 | 2/1995 | Ouchi | 29/890.053 |

FOREIGN PATENT DOCUMENTS

| | | | |
|---|---|---|---|
| 56-71520 A | 6/1981 | Japan . | |
| 85326 | 5/1984 | Japan | 72/181 |
| 2 636 253 | 3/1990 | Japan . | |
| 6-123571 | 5/1994 | Japan . | |
| A-6-123571 | 5/1994 | Japan . | |
| 7-41331 | 5/1995 | Japan . | |
| B2-7-41331 | 5/1995 | Japan . | |
| 837468 | 6/1981 | U.S.S.R. | 72/181 |
| 1344459 | 10/1987 | U.S.S.R. | 72/181 |
| 1558529 | 4/1990 | U.S.S.R. | 72/181 |

*Primary Examiner*—Daniel C. Crane
*Attorney, Agent, or Firm*—Harness, Dickey & Pierce, PLC

[57] ABSTRACT

According to the present invention, a roll forming method includes a first roll forming process for forming a trapezoidal projecting portion at a center portion, a second roll forming process for gradually narrowing an upper side of the trapezoidal projecting portion to form a turnup projecting portion, a third roll forming process for forming perpendicularly folded portions at both sides, and a fourth roll forming process for folding a middle portion between the perpendicularly folded portion and the turnup projecting portion in a semi-circular shape. In this way, it is possible to form a turnup projecting portion, insides of which are closely contacted to each other with a curvature which is larger than the conventional curvature, with high speed.

12 Claims, 12 Drawing Sheets

ROLL FORMING METHOD FOR FORMING FLAT TUBE AND ROLL FORMING APPARATUS USING THE SAME

CROSS REFERENCE TO THE RELATED APPLICATION

This application is based on and claims priority of Japanese Patent Application of No. Hei. 8-265303 filed on Sep. 16, 1996, the content of which is incorporated herein by reference.

BACKGROUND OF THE INVENTION

1. Field of the Invention

The present invention relates to a roll forming method for forming a flat tube having a reinforced portion at a center thereof, which is used for a heat exchanger or the like.

2. Description of Related Art

In a radiator for a vehicle, a heat exchanger of a hot water type heating apparatus, or the like, there is used a flat tube through which a fluid for heat exchange flows. The flat tube is brazed to a container (such as a tank) of the heat exchanger.

As a flat tube employed for a heat exchanger having a large width, as shown in FIG. 33, there has been proposed a flat tube 90 having a θ-shaped cross section, in which a reinforced portion 91 is provided at a center thereof (as disclosed in JP-A-6-123571). The reinforced portion 91 is composed of edge portions 911 bent perpendicularly at each end of a plate material and a projecting portion 912 folded into a mountain shape at a center portion of the plate material, and both of the edge portions and the projecting portion are connected to each other by brazing.

Further, as a method for continuously cold-forming a long member such as a flat tube on mass production, there has been known a roll forming method.

For example, as disclosed in JP-B2-7-41331, as a method for bending both ends of a belt plate perpendicularly by a roll forming, there has been proposed a forming method composed of separate three processes including a process for bending both ends by approximately 45° a process for bending both ends by approximately 70°, and a process for bending both ends by approximately 90°.

As described above, because the reinforced portion 91 of the flat tube 90 is, as shown in FIG. 33, composed of the edge portions 911 bent perpendicularly and the projecting portion 912 folded in a mountain shape, those portions should be formed not to create a large gap (depression 925) therebetween, and should be fixedly connected to each other.

If the depression 925 between the edge portion 911 and the projecting portion 912 is large, when the flat tube 90 is brazed to a container 99 such as a tank, the gap which cannot be filled up by brazing still remains, and there occurs a problem of leakage or the like. Therefore, it is necessary to reduce both of an outer curvature radius 921 of the edge portion 911 and a curvature radius 922 at a top portion of the projecting portion 912.

However, it is extremely difficult to perform a roll forming with high accuracy and with high speed while reducing the curvature radii of the above-described edge portion 911 and the projecting portion 912.

For example, when the above-described projecting portion 912 is roll-formed, as shown in FIG. 30, a transverse width of a belt-shaped plate 94 is drawn in (narrowed), and then, as shown in FIG. 31, a projecting portion 95 is formed in a triangular mountain shape. An angle a of the mountain of the projecting portion 95 is gradually made acuter every step of the roll-forming.

However, while being formed, a tensile stress is applied to the top portion of the mountain of the projecting portion 95, and if being formed larger, the top portion is constricted to have a thin thickness. Further, if the curvature of the top portion is made larger, there may occur a problem of fracture or the like. That is, as shown in FIG. 30, the belt-shaped plate is held between rollers and is drawn in from a width direction to form a mountain-shaped projecting portion, a tensile stress T is applied to the top portion of the mountain of the projecting portion 95, as described below.

A first factor constituting the above-described tensile stress T is caused by a deformation resistance when the material is drawn in, and the deforming resistance is due to a shearing resistance of a flat portion (non-mountain portion). That is, a tensile force R (FIG. 31) applied to the top portion per length in a longitudinal direction is expressed as the following formula.

$$R=Sa\times\sigma a \tag{1}$$

wherein Sa is a transverse cross section of the flat portion (non-mountain portion), i.e., the transverse width w of the non-mountain portion×the plate thickness t, and σa is a deformation resistance (stress) of the material.

A second factor constituting the above-described tensile stress T is caused by a bending stress σv of the top portion of the mountain (similarly, per length in the longitudinal direction as shown in FIG. 31), and the tensile stress T is expressed as the following formula with the above-described R.

$$T=(R/t)+\sigma v=(Sa\times\sigma a)/t+\sigma v \tag{2}$$

When the above-described stress T is larger than the tensile strength of the material, as shown in FIG. 32, a constriction 951 is caused on the top portion (the plate thickness is changed from t to t' by the constriction).

Therefore, it is necessary to roll-form the projecting portion while restricting a drawing amount of the material and a bending amount (curvature). Accordingly, the curvature of the top portion of the mountain cannot be increased excessively, and it is necessary to form by multi-stages, with the result that the number of the processes of the roll forming is increased.

SUMMARY OF THE INVENTION

The present invention has been accomplished in view of the above-mentioned problems, and it is an object of the invention to provide a roll forming method and an apparatus using the same for forming a flat tube is provided with a reinforced portion having a projecting portion folded at a center thereof, with high accuracy and with high speed, in which the curvature of the curved portion of the above-described reinforced portion is made large and the depression of the reinforced portion is made smaller.

According to a the present invention, a roll forming method for forming a flat tube having a θ-shaped cross section by continuously bending a sheet of a long belt plate material, in which a reinforced portion is provided at a center thereof, includes the following four processes.

In a first roll forming process, a trapezoidal projecting portion having an upper side is formed at a center portion of the belt plate material in a width direction thereof.

In a second roll forming process, the upper side of the trapezoidal projecting portion is gradually narrowed such that said projecting portion is formed substantially in a triangular shape and then for forming a turnup projecting portion by closely contacting insides of projecting two sides of the triangular projecting portion.

In a third roll forming process, perpendicularly folded portions are formed at both sides of the belt plate material in a transverse width direction in such a manner that each of the perpendicularly folded portions has a height smaller than a height of the turnup projecting portion.

In a fourth roll forming process, a middle portion between the perpendicularly folded portion and the turnup projecting portion is formed in a semi-circular shape such that flat portions adjacent to the middle portion are in parallel with each other and each of the folded portions is closely contacted with each side surface of the turnup projecting portion.

The most noticeable points in the present invention are that the trapezoidal projecting portion is formed at the center portion of the belt plate material in the width direction in the first process and that a triangular projecting portion is formed by gradually narrowing the upper side of the trapezoidal projecting portion and then a turnup projecting portion is formed by closely contacting insides of projecting two sides of the triangular projecting portion.

By forming the trapezoidal projecting portion at first, a size of the tensile force R expressed by the formula (1) is reduced as described below. Further, because a curvature radius of a curved portion in the trapezoidal projecting portion is increased, the bending stress $\sigma v$ is decreased, an area in which the stress is applied is dispersed, and the tensile stress T expressed by the formula (2) is reduced.

That is, because the transverse width w of the non-mountain portion (flat portion) in the formula (1) is narrowed, the transverse cross sectional area Sa of the flat portion (non-mountain portion) is decreased, and the tensile force R is decreased.

Therefore, it becomes difficult for the bent portion to be constricted.

Further, because a position of the bent portion is shifted while gradually narrowing the width of the upper side of the trapezoid, the tensile stress does not concentrate on one spot. In this way, it becomes further difficult for the bent portion to be constricted. Through such steps, the curvature of the bent portion is increased, and in the final stage the turnup projecting portion is formed by closely contacting insides of projecting two sides of the triangular projecting portion with each other.

Therefore, according to the roll forming method of the present invention, it is possible to form the turnup projecting portion, insides of which are closely contacted to each other with a curvature which is larger than the conventional curvature, with high speed.

Further, the second roll forming process may include a pressing forming process for heading and pressing the turnup projecting portion from an upper side thereof while reducing a curvature radius of a curved portion thereof, to form the turnup projecting portion in a rectangular shape.

Still further, the third roll forming process may include an intermediate bending process for bending a portion to be bent perpendicularly by a middle angle in a range of a bending angle 30°–60°, and a final bending process for bending perpendicularly the portion bent by the middle angle while heading the portion from an end portion thereof toward a curved portion only by a size $\Delta$ being 0.6 to 1.6 times as much as a plate thickness t of the belt plate material.

In this way, an outer curvature radius r of the curved portion is preferably set to or less than the plate thickness t.

The preferable curvature radius r ($r \leqq t$) is a standard value not to create a large depression improperly when the flat tube is brazed to a container.

Further, the middle portion between the perpendicularly folded portion and the turnup projecting portion may be bent in a semi-circular shape while applying a pressing force F directing from the perpendicularly folded portion toward the semi-circular folded portion.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

A first embodiment of the present invention will be described.

In this embodiment, a roll forming apparatus 1 (FIG. 1) is for forming a flat tube 81 (FIG. 3E) provided with a reinforced portion having a θ-shaped cross section at a center thereof by folding a sheet of a long belt plate 40 (FIG. 2A) continuously.

Figure 1:
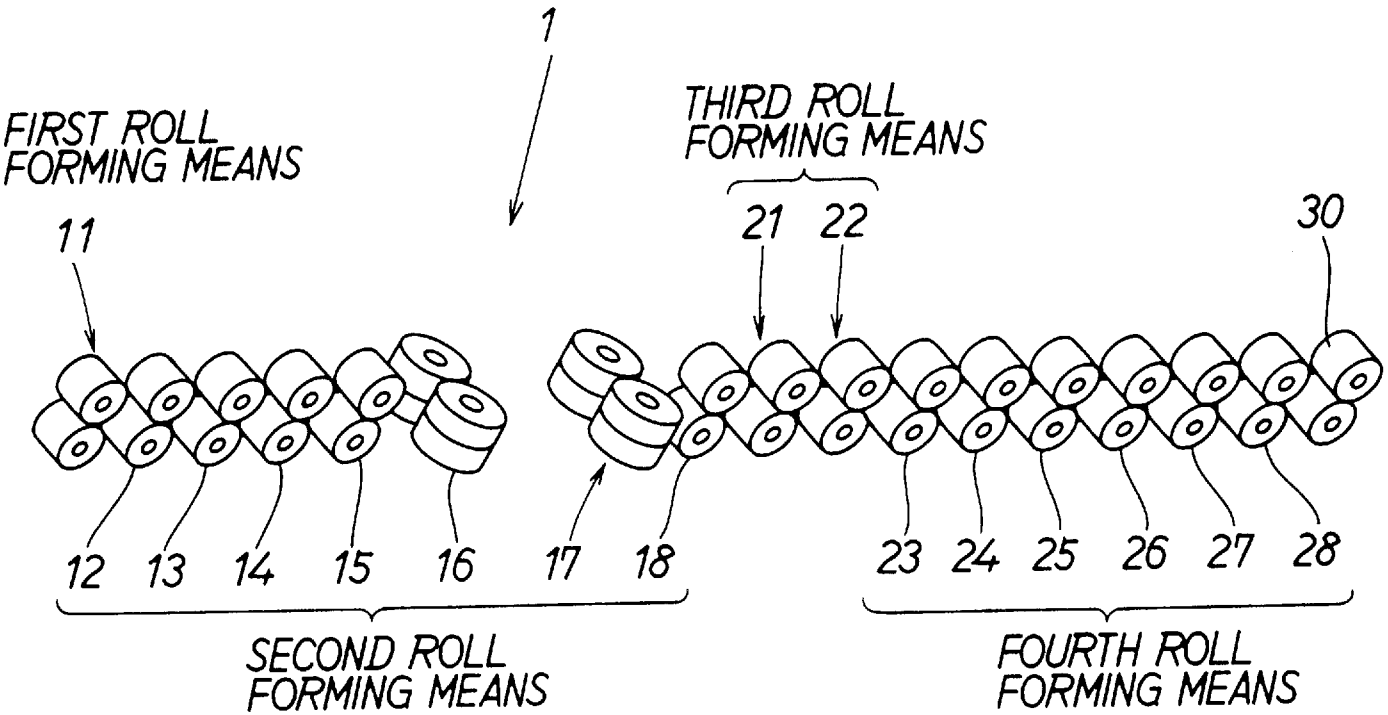
FIG. 1 is a view showing a layout of a roll forming apparatus according to an embodiment of the present invention.
Figure 2A:
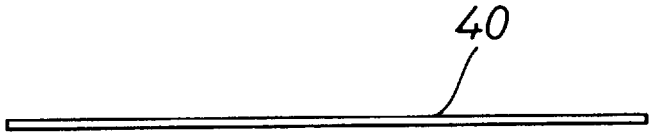
FIGS. 2A to 2F show sequentially formed states of a material in a first and a second forming processes in the embodiment.
Figure 12:
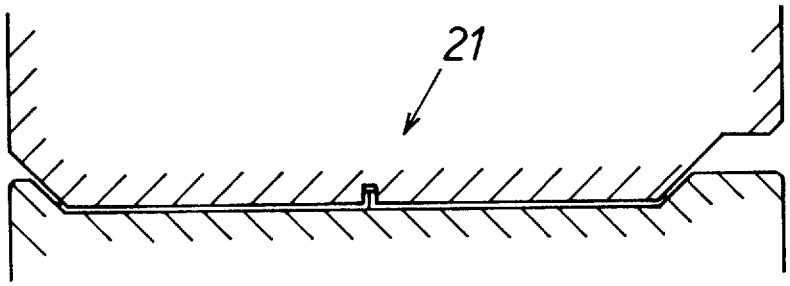
FIG. 12 shows shapes of rolls in a middle bending process in the third roll forming means.
Figure 13:
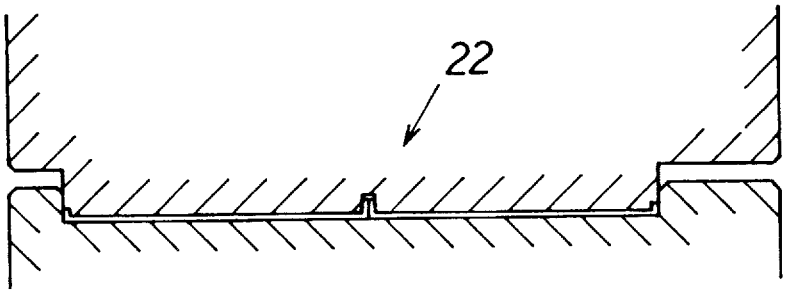
FIG. 13 shows shapes of rolls in a final bending process in the third roll forming means.
Figure 14:
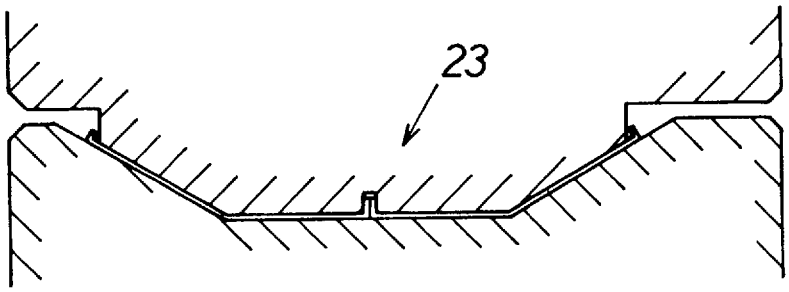
FIG. 14 shows shapes of rolls for bending by an angle of 30° in the fourth roll forming means.
Figure 15:
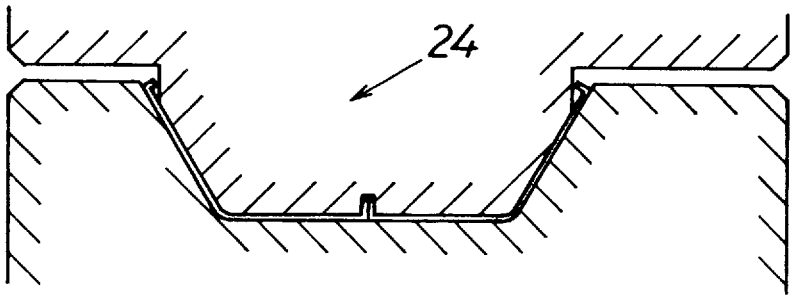
FIG. 15 shows shapes of rolls for bending by an angle of 60° in the fourth roll forming means.
Figure 16:
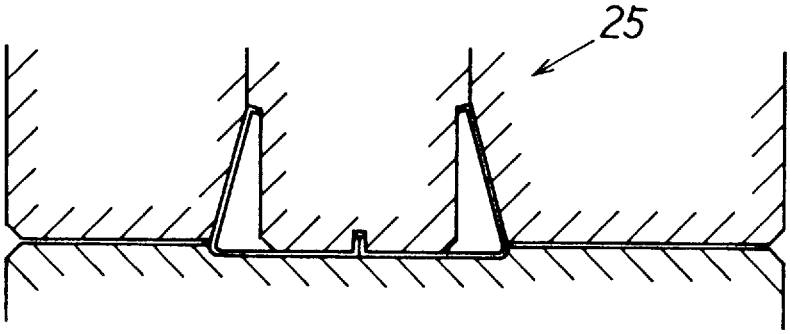
FIG. 16 shows shapes of rolls for bending by an angle of 105° in the fourth roll forming means.
Figure 17:
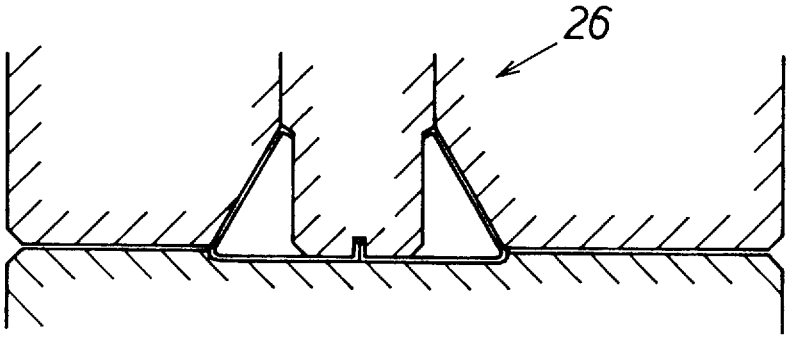
FIG. 17 shows shapes of rolls for bending by an angle of 120° in the fourth roll forming means.
Figure 18:
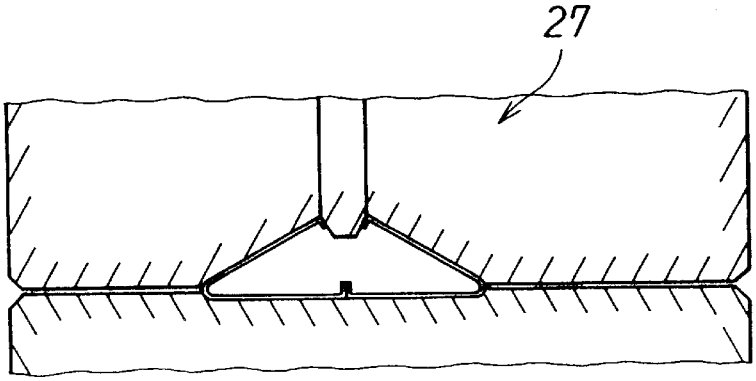
FIG. 18 shows shapes of rolls for bending by an angle of 150° in the fourth roll forming means.
Figure 19:
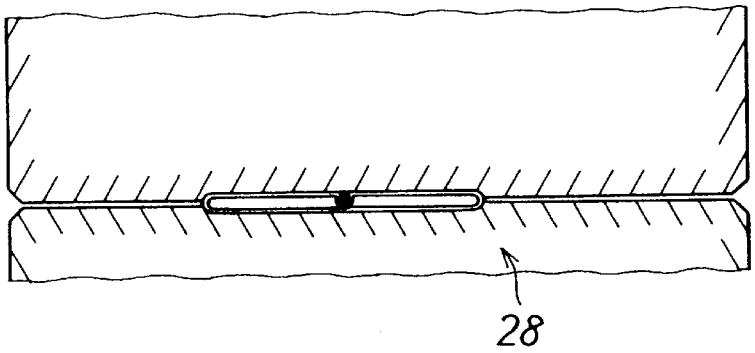
FIG. 19 shows shapes of rolls for bending by an angle of 180° in the fourth roll forming means.

As shown in FIG. 1, the roll forming apparatus 1 is provided with a first roll forming means 11 (FIG. 4) for forming a projecting portion 416 (FIG. 2A) formed in a trapezoidal shape at a center portion of the belt plate 40 in a width direction thereof, a second roll forming means 12–18 (FIGS. 5–11) for forming a turnup projecting portion 43, 44 (FIGS. 2D and 2E) in which a projecting portion 426 (FIG. 2C) is formed substantially in a triangular shape by gradually narrowing a width L1 of upper side of the trapezoid and then two projecting sides are closely contacted inside, a third roll forming means 21 and 22 (FIGS. 12 and 13) for forming perpendicularly folded portions 456 (FIG. 3B) having a height equal to or smaller than a height H of the turnup projecting portion 44 at each end of the belt plate 40 in the transverse width direction, and a fourth roll forming means 23–28 (FIGS. 14–19) for bending a middle portion between the perpendicularly folded portion 456 and the turnup projecting portion 44 in a circular shape in such a manner that the flat plate portion 468 and 469 (FIG. 3E) are in parallel with each other and for closely contacting the folded portions 456 to both side surfaces of the turnup projecting portion 44.

The second roll forming means 12–18 include pressing forming means 18 (FIG. 11) for heading and pressing the turnup projecting portion 43 from an upper side thereof to reduce a curvature radius of a curved portion, so that the turnup projecting portion is formed in a rectangular shape.

Figure 3A:
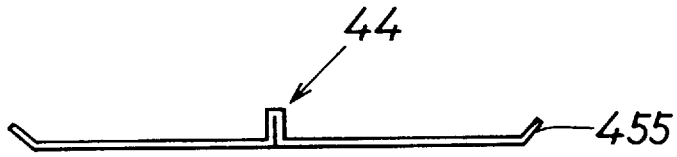
FIGS. 3A to 3E show sequentially formed states of a material in a third and a fourth forming processes in the embodiment.
Figure 23A:
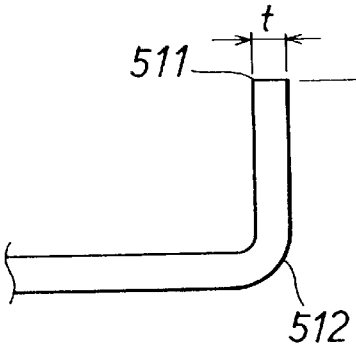
FIG. 23A shows a shape of a product bent without heading from an end portion toward a curved portion in the third roll forming process in the embodiment.
Figure 23B:
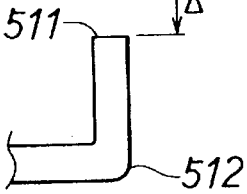
FIG. 23B shows a shape of a product bent while heading from the end portion toward the curved portion in the third roll forming process in the embodiment.

The third roll forming means 21 and 22 for forming the perpendicularly folded portion 456 includes, as shown in FIG. 3A, intermediate bending roll forming means 21 (FIG. 12) for bending by a middle angle 45° of the bending angle 30°–60° and a final bending roll forming means 22 (FIG. 13) for bending the perpendicularly folded portion 455 (FIG. 3A) bent by the middle angle 45° while heading the folded portion 455 from an end portion 511 toward the curved portion 512 only by a size Δ being 0.6 to 1.6 times as much as the plate thickness t, as shown in FIG. 23.

Figure 25:
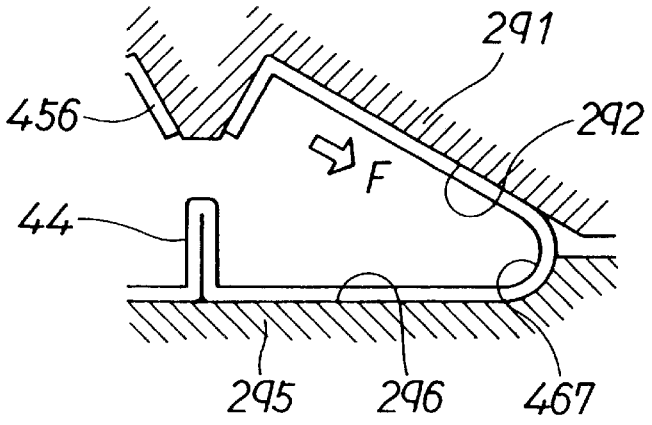
FIG. 25 shows a curved shape of a formed product when a pressing force F directing from a perpendicularly folded portion side to a semi-circular curved portion side is applied in the fourth roll forming process in the embodiment.
Figure 26:
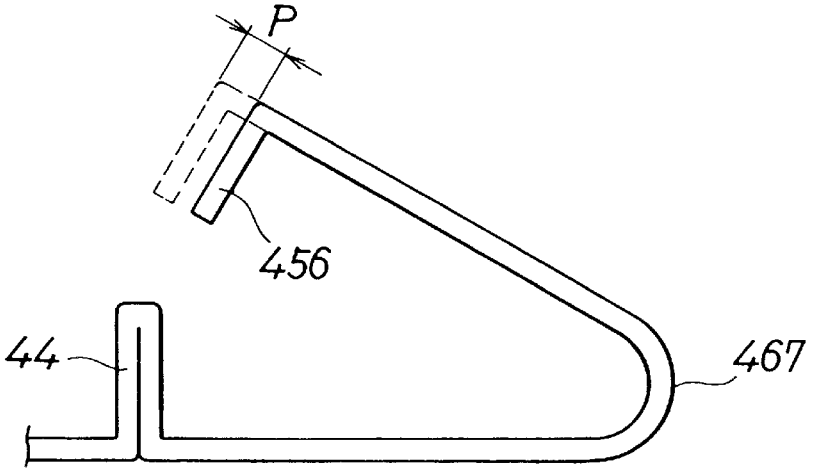
FIG. 26 shows a deformed amount P to apply the pressing force F directing from the perpendicularly folded portion side to the semi-circular curved portion side is applied in the fourth roll forming process in the embodiment.

The fourth roll forming means 23–28 include pressing roll forming means 25–27 for applying a force F directing from the perpendicularly folded portion 456 to a semi-circular folded portion 467, as shown in FIG. 25, when a middle portion between the perpendicularly folded portion 456 and the turnup projecting portion 44 is folded in a semi-circular shape.

Hereinafter, an explanation will be supplemented.

Figure 27:
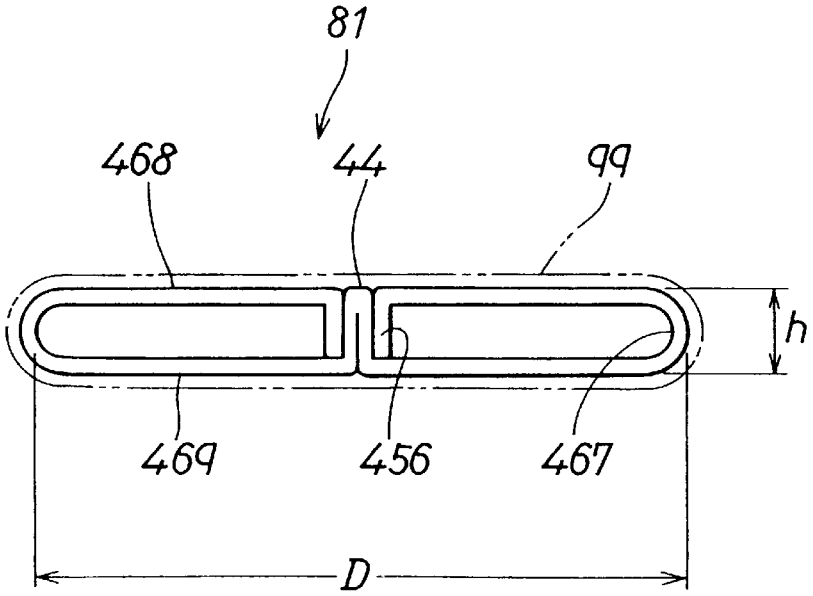
FIG. 27 is a cross sectional view of a flat tube formed in the embodiment.

The flat tube 81 (FIG. 27) formed in this embodiment is used for a radiator for a vehicle, or a heat exchanger of a hot water type heating apparatus or the like, and is made of aluminum. A thickness thereof is approximately in a range of 0.25–0.30 mm. A transverse width D shown in FIG. 27 is approximately in a range of 16–27 mm, and a height h is approximately in a range of 1.4–1.8 mm. Therefore, a width of the belt plate 40 (FIG. 2A) as the raw material is approximately in a range of 40–60 mm.

The roll forming apparatus 1 includes, as shown in FIG. 1, roll forming means 11–15, 18, 21–28 each having a horizontal rotation axis of rolls thereof, and roll forming means 16 and 17 each having a perpendicular rotation axis of rolls thereof.

Figure 2B:
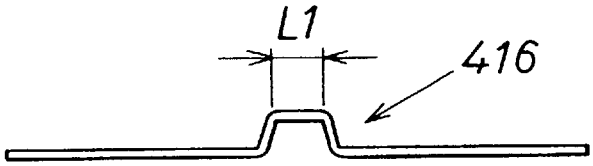
Figure 2C:
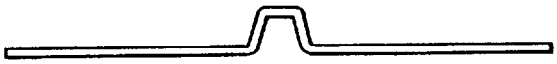
Figure 4:
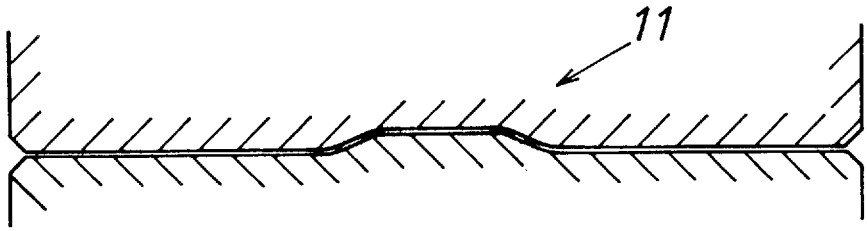
FIG. 4 shows shapes of rolls in a first roll forming means in the embodiment.
Figure 5:
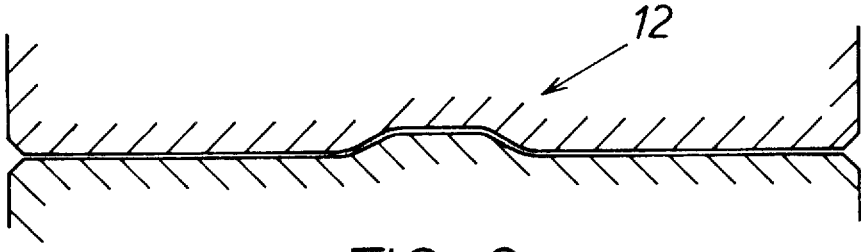
FIG. 5 shows shapes of rolls at a first step in the second roll forming means in the embodiment.
Figure 6:
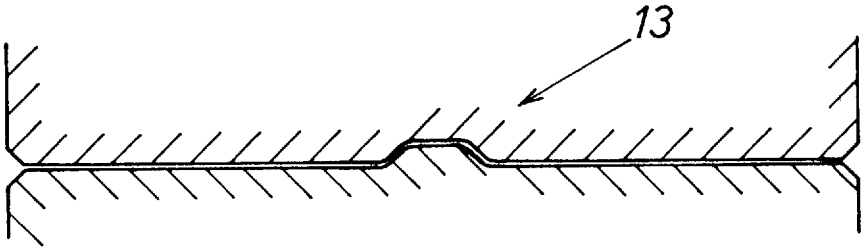
FIG. 6 shows shapes of rolls at a second step in the second roll forming means in the embodiment.
Figure 7:
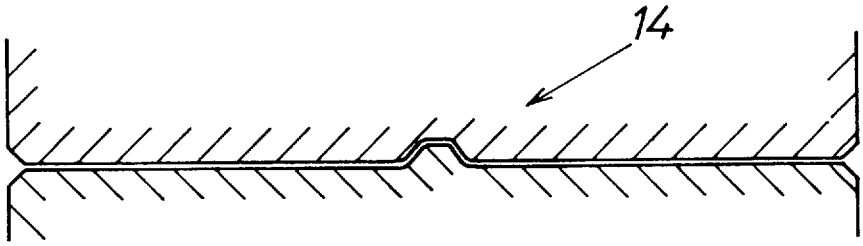
FIG. 7 shows shapes of rolls at a third step in the second roll forming means in the embodiment.

Firstly, by using the roll forming means 11 shown in FIG. 4, as shown in FIG. 2B, a projecting portion 416 is formed in a trapezoidal shape having a large width L1 at an upper side thereof. Then, by using the roll forming means 12–14, as shown in FIGS. 2B and 2C, the width L1 of the upper side of the trapezoid is gradually shortened.

Figure 2D:
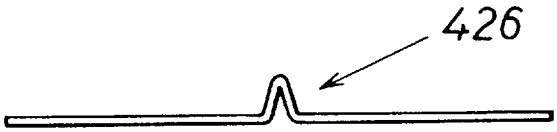
Figure 2E:
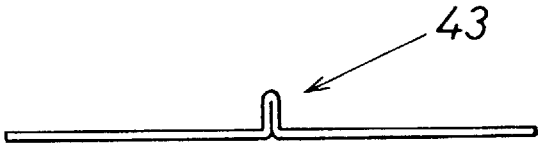
Figure 8:
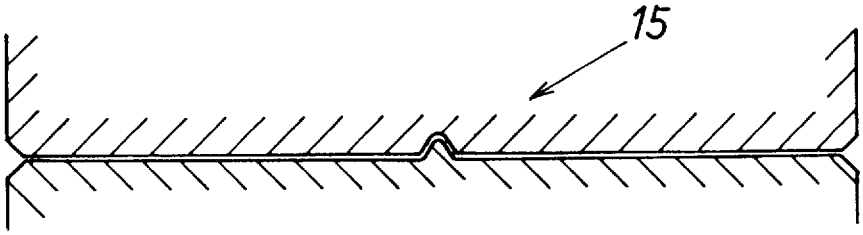
FIG. 8 shows shapes of rolls at a fourth step in the second roll forming means in the embodiment.
Figure 9:
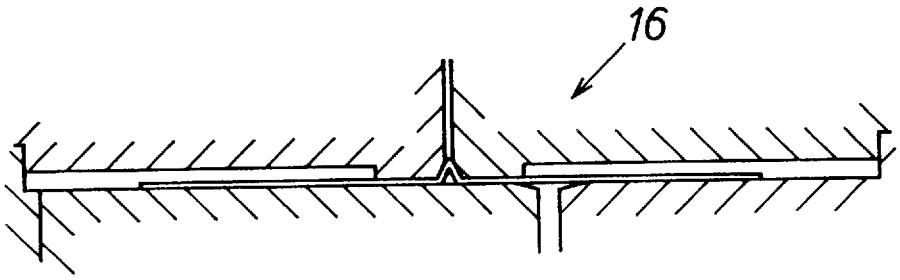
FIG. 9 shows shapes of rolls each having a perpendicular rotation axis at a fifth step in the second roll forming means in the embodiment.

Further, by using the roll forming means 15 shown in FIG. 8, as shown in FIG. 2D, a projecting portion 426 is formed in a triangular shape.

Figure 10:
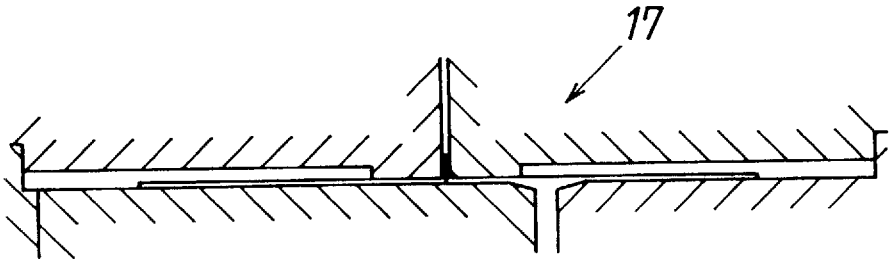
FIG. 10 shows shapes of rolls each having a perpendicular rotation axis at a sixth step in the second roll forming means in the embodiment.
Figure 11:
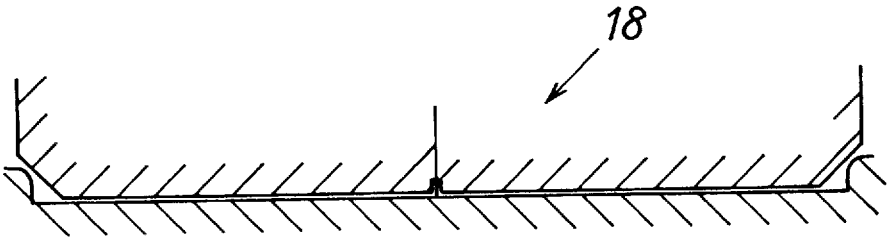
FIG. 11 shows shapes of rolls for heading and pressing a turnup projecting portion at a seventh step in the second roll forming means in the embodiment.
Figure 21:
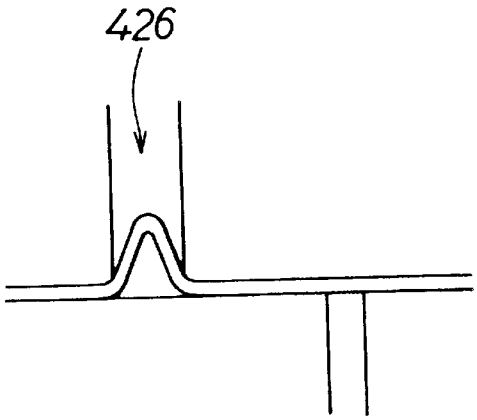
FIG. 21 is an enlarged view showing a main portion of the roll forming means of FIG. 9.
Figure 22:
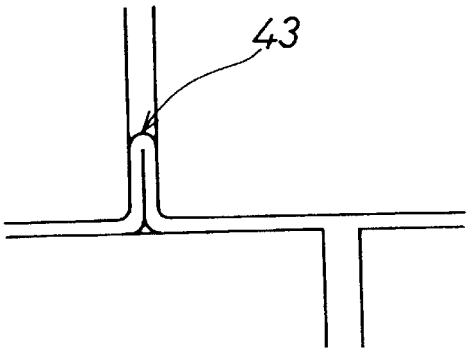
FIG. 22 is an enlarged view showing a main portion of the roll forming means of FIG. 10.

Next, by using the roll forming means 16 and 17 each having the perpendicular rotation axis of the rolls, shown in FIGS. 10 and 11, each inside of two projecting sides is closely contacted to form a turnup projecting portion 43, as shown in FIGS. 21 and 22.

Figure 2F:
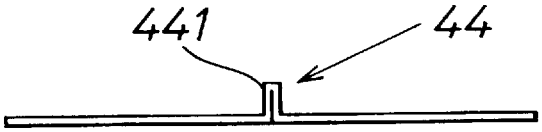

Sequentially, by using the roll forming means 18 having a horizontal rotation axis, shown in FIG. 11, a turnup projecting portion 44 shown in FIG. 2F is formed in a rectangular shape, by heading and pressing the turnup projecting portion 43 from an upper side thereof to reduce a curvature radius of a curved shape.

Figure 20:
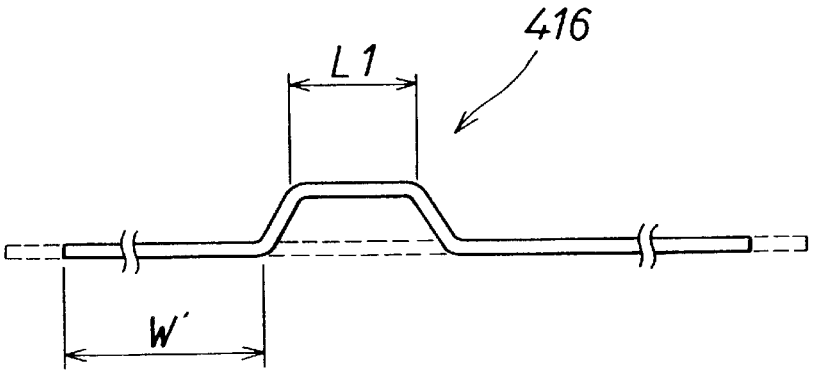
FIG. 20 is a view in which a trapezoidal projecting portion and a flat portion are overlapped with a belt plate (broken line)
Figure 30:
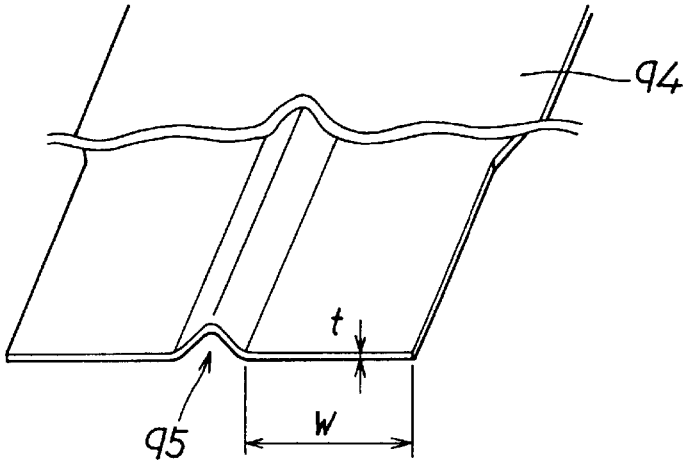
FIG. 30 RELATED ART
FIG. 30 is a deforming state of the material when a belt-shaped plate is roll-formed to form a mountain-shaped projecting portion.
Figure 31:
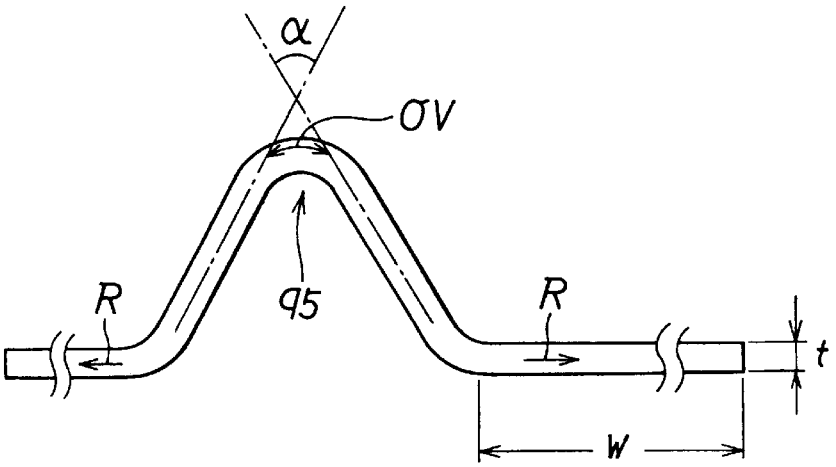
FIG. 31 RELATED ART
FIG. 31 is an enlarged view of a projecting portion of FIG. 30.

By forming with the above-described processes, firstly, when the trapezoidal projecting portion is formed as shown in FIG. 20, a transverse width w' of the non-mountain portion (flat portion) becomes narrower than a transverse width w shown in FIG. 30; and therefore, a transverse cross section Sa of the flat portion (non-mountain portion) is reduced, and a tensile force R in the formula (1) decreases.

Figure 32:
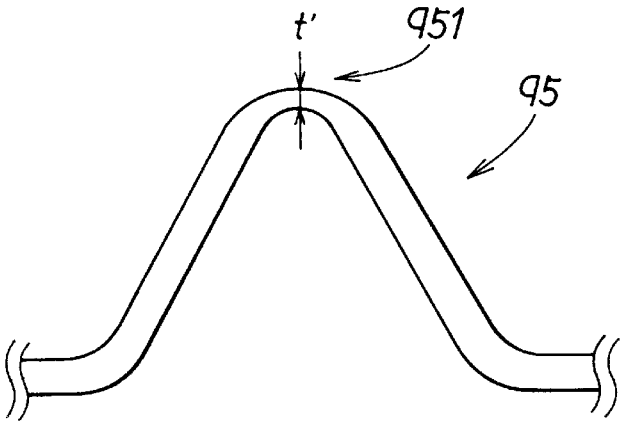
FIG. 32 RELATED ART
FIG. 32 shows a state in which the projecting portion of FIG. 31 is deformed.
Figure 33:
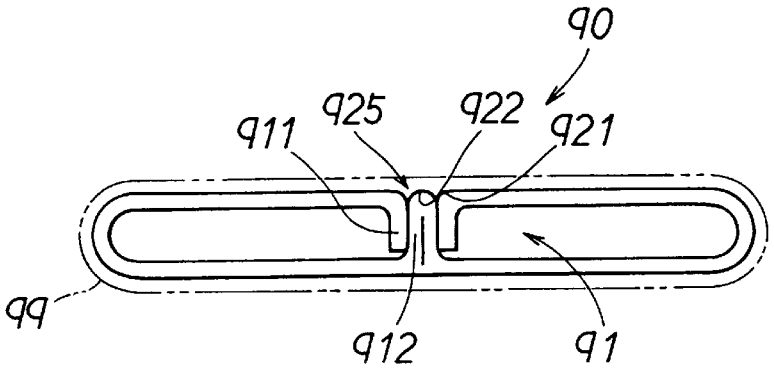
FIG. 33 PRIOR ART
FIG. 33 is a cross sectional view of a flat tube formed by a conventional method.

Further, because a position of the bent portion is shifted while gradually narrowing the width L1 of the upper side of the trapezoid, the above-described tensile stress does not concentrate on one spot. Therefore, there is no possibility that the projecting portion is constricted (like the constricted portion 951 shown in FIG. 32).

Further, by using the roll forming means 18, the forming process for heading and pressing the turnup projecting portion 43 from an upper side thereof is included. Therefore, the top portion is made flat, and the curvature of the top portion at each side can be further increased. As a result, the top portion of the turnup projecting portion 44 of the flat tube 81 shown in FIG. 2F becomes flat. In this embodiment, the curvature radius of the both side portions 441 of the top portion can be made to be equal to or less than 0.25 mm.

Next, as shown in FIG. 3A, both side portions 455 of an intermediate product in which the turnup projecting portion 44 is formed by the roll forming means 21 (FIG. 12) are bent by an angle of 45°.

Figure 3B:
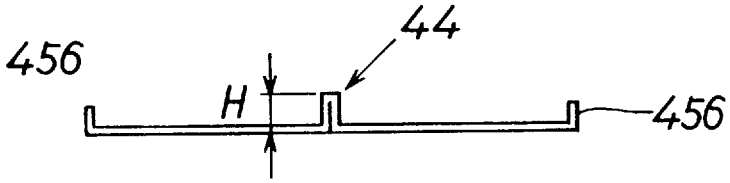

Sequentially, as shown in FIG. 3B, by using the roll forming means 22 (FIG. 13), both side portions 455 are folded and bent perpendicularly to form the perpendicularly folded portions 456. At this time, as shown in FIG. 23, the side portion 455 is folded and bent perpendicularly while heading the side portion 455 from the end portion 511 toward the curved portion 512 only by a size Δ being 0.6 to 1.6 times as much as the plate thickness t, as shown in FIG. 23.

By setting the heading amount Δ in a range of 0.6–1.6 times as much as the plate thickness t, the curvature of the curved portion 512 bent perpendicularly can be increased without causing buckling, deformation, or the like. As a result, the outer curvature radius of the curved portion 512 can be set preferably to be equal to or less than the plate thickness t.

Figure 24:
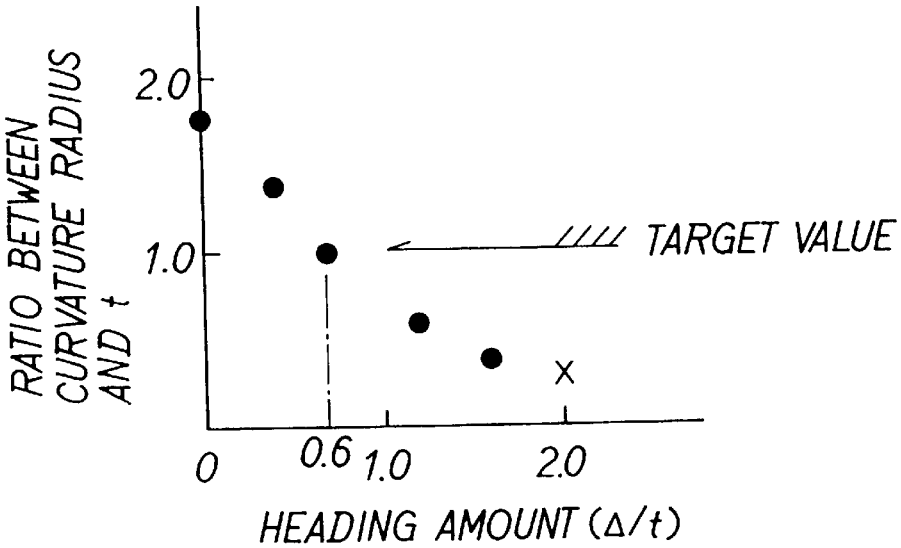
FIG. 24 shows a variation of a curvature radius of a curved portion when a heading amount Δ is varied in FIG. 23.

FIG. 24 shows a relationship between a size of a heading amount (relative value=a ratio between the size Δ and the plate thickness t) and an outer curvature radius of the curved portion 512. As being understood therefrom, by setting the size of the heading amount to be equal to or more than 0.6 t, the curvature radius can be set to a preferable target value which is equal to or less than the plate thickness t.

Figure 28:
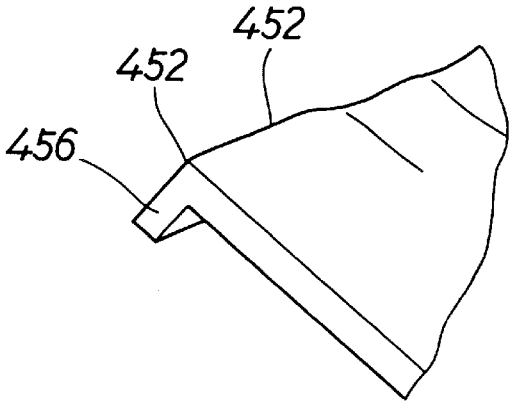
FIG. 28 is a deformation of a curved portion when a heading amount applied from an end portion to the curved portion is increased excessively.

However, when the heading amount Δ is set to exceed 1.6 t, as shown in FIG. 28, portions adjacent to the bent portion 452 are deformed in a wavy shape, and when the heading amount Δ is set to exceed 2.0 t, the buckling phenomenon is observed (the mark "×" in FIG. 24).

Therefore, it is preferable that the heading amount should be in a range of 0.6–1.6 t.

Next, by using the roll forming means 23 (FIG. 14), the middle portion between the perpendicularly folded portion 456 and the turnup projecting portion 44 is folded and bent by an angle of 30°.

Figure 3C:
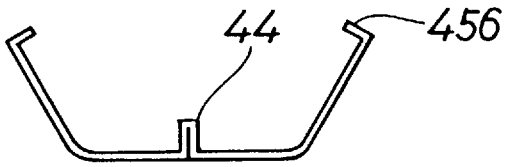
Figure 3D:
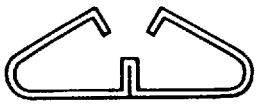
Figure 3E:
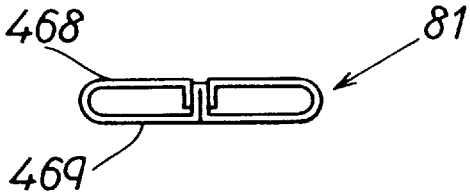

Sequentially, as shown in FIGS. 3C and 3D, by using the roll forming means 24–27 (FIGS. 15–18), the middle portion between the perpendicularly folded portion 456 and the turnup projecting portion 44 is gradually folded and bent by angles of 60°, 105° (not shown), 120° (not shown), and 150° in this order.

Figure 29:
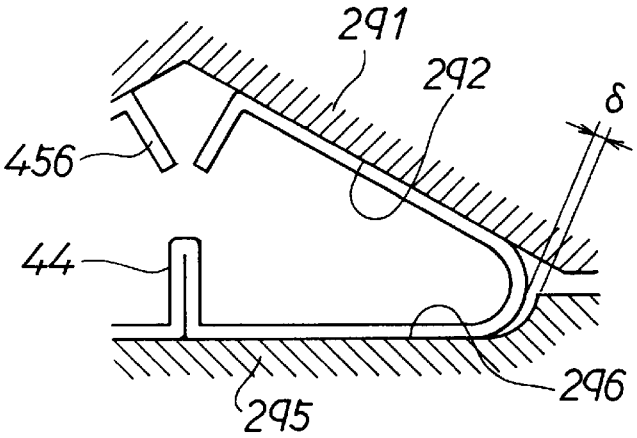
FIG. 29 shows a gap δ formed between an inner wall of a roll and a product formed without applying a pressing force F directing from a perpendicularly folded portion side to a semi-circular folded portion in the third roll forming process.

At this time, as shown in FIG. 25, the middle portion is folded and bent while applying a pressing force F directing from the perpendicularly folded portion 456 to the semi-circular folded portion 467. As a result, as shown in FIG. 25, there is no occurrence of a gap between an inner wall 292 of an upper roll 291 and the formed product and between an inner wall 296 of a lower roll 295 and the formed product. That is, when the middle portion is folded and bent without applying the above-described pressing force F, as shown in FIG. 29, there occurs a gap δ between a desired curved line formed by the inner walls 292 and 296 of the upper roll 291 and the lower roll 295; however, by applying the above-described pressing force, the gap δ can be completely eliminated in this embodiment.

In this embodiment, a pushing amount P for generating the above-described pressing force, by the upper roll 291, is approximately 0.2 mm.

Finally, by using the forming roll 28 (FIG. 19), the flat portions 468 and 469 are made in parallel with each other, and the folded portions 456 are closely contacted each side of the turnup projecting portion 44.

Then, by using a transferring roll 30 shown in FIG. 1, a formed product is supplied to the next process.

As described above, in this embodiment, the curvature radius of the curved portion 512 in the perpendicularly folded portion 456 is equal to or less than the plate thickness t, the top portion of the turnup projecting portion 44 is flat, and the curvature radius of the top portion at each side is equal to or less than 0.25 mm. Thus, the flat tube 81 having only a small number of depressions formed between the perpendicularly folded portions 456, on an upper surface thereof, can be obtained satisfactorily.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A roll forming method for forming a flat tube having a θ-shaped cross section by continuously bending a sheet of a long belt plate material, in which a reinforced portion is provided at a center thereof, said roll forming method comprising the steps of:

forming a trapezoidal projecting portion having an upper side at a center portion of the belt plate material in a width direction thereof;

gradually narrowing said upper side of said trapezoidal projecting portion such that said projecting portion is formed substantially in a triangular shape;

forming a turnup projecting portion by closely contacting insides of projecting two sides of said triangular projecting portion;

forming perpendicularly folded portions at both sides of the belt plate material in a transverse width direction, said perpendicularly folded portions each having a height smaller than a height of said turnup projecting portion;

folding a middle portion between said perpendicularly folded portion and said turnup projecting portion in a semi-circular shape such that flat portions adjacent to said middle portion are parallel with each other; and closely contacting said folded portion with a side surface of said turnup projecting portion.

2. A roll forming method according to claim 1, wherein said step of forming said turnup projecting portion includes heading and pressing said turnup projecting portion from an upper side thereof while reducing a curvature radius of a curved portion thereof, to form said turnup projecting portion in a rectangular shape.

3. A roll forming method according to claim 1, wherein, said step of forming said perpendicularly folded portions at both sides of the belt plate material in said transverse includes:

bending a portion to be bent perpendicularly by a middle angle in a range of a bending angle 30°–60°; and bending perpendicularly said portion bent by said middle angle while heading said portion from an end portion thereof toward a curved portion.

4. A roll forming method according to claim 3, wherein the step of heading said portion heads said portion from said end portion toward said curved portion thereof only by a size Δ being 0.6 to 1.6 times as much as a plate thickness t of the belt plate material.

5. A roll forming method according to claim 1, wherein, said step of folding said middle portion folds said middle portion between said perpendicularly folded portion and said turnup projecting portion in a semi-circular shape while applying a pressing force F directing from said perpendicularly folded portion toward said semi-circular folded portion.

6. A roll forming apparatus for forming a flat tube having a θ-shaped cross section by continuously bending a sheet of a long belt plate material, in which a reinforced portion is provided at a center thereof, said roll forming apparatus comprising:

a first roll forming unit for forming a trapezoidal projecting portion having an upper side at a center portion of the belt plate material in a width direction thereof;

a second roll forming unit for gradually narrowing said upper side of said trapezoidal projecting portion such that said projecting portion is formed substantially in a triangular shape and then for forming a turnup projecting portion by closely contacting insides of projecting two sides of said triangular projecting portion;

a third roll forming unit for forming perpendicularly folded portions at both sides of the belt plate material in a transverse width direction, said perpendicularly folded portions each having a height smaller than a height of said turnup projecting portion; and a fourth roll forming unit for folding a middle portion between said perpendicularly folded portion and said turnup projecting portion in a semi-circular shape such that flat portions adjacent to said middle portion are in parallel with each other and for closely contacting said folded portions with a side surface of said turnup projecting portion.

7. A roll forming apparatus according to claim 6, wherein said second roll forming unit includes a pressing forming unit for heading and pressing said turnup projecting portion from an upper side thereof while reducing a curvature radius of a curved portion thereof, to form said turnup projecting portion in a rectangular shape.

8. A roll forming apparatus according to claim 7, wherein, said second roll forming unit includes:

a plurality of a pair of rolls each having a horizontal rotation axis, for narrowing said upper side of said trapezoidal projecting portion;

a plurality of a pair of rolls each having a perpendicular rotation axis, for forming a turnup projecting portion by closely contacting insides of projecting two sides of said triangular projecting portion; and a pair of rolls for heading and pressing said turnup projecting portion while reducing the curvature radius of said curved portion.

9. A roll forming apparatus according to claim 6, wherein, said third roll forming unit for forming perpendicularly folded portions includes:

an intermediate bending unit for bending a portion to be bent perpendicularly by a middle angle in a range of a bending angle 30°–60°; and a final bending unit for bending perpendicularly said portion bent by said middle angle while heading said portion from an end portion thereof toward a curved portion.

10. A roll forming apparatus according to claim 9, wherein said final bending roll unit heads said portion from said end portion toward said curved portion thereof only by a size Δ being 0.6 to 1.6 times as much as a plate thickness t of the belt plate material.

11. A roll forming apparatus according to claim 6, wherein said fourth roll forming unit folds said middle portion between said perpendicularly folded portion and said turnup projecting portion in a semi-circular shape while applying a pressing force F directing from said perpendicularly folded portion toward said semi-circular folded portion.

12. A roll forming apparatus according to claim 6, wherein said fourth roll forming unit includes a plurality of a pair of rolls having different forming angles from each other, to fold said middle portion between said perpendicularly folded portion and said turnup projecting portion step by step.

* * * * *